US005676605A

United States Patent [19]

Kobayashi

[11] Patent Number: 5,676,605

[45] Date of Patent: Oct. 14, 1997

[54] METHOD FOR MANUFACTURING IRON-TYPE GOLF CLUB HEAD

[75] Inventor: Kenji Kobayashi, Tsubame, Japan

[73] Assignee: K.K. Endo Seisakusho, Niigata-ken, Japan

[21] Appl. No.: 642,879

[22] Filed: May 6, 1996

[30] Foreign Application Priority Data

Jan. 5, 1996 [JP] Japan ..... 8-000247

[51] Int. Cl.[6] ..... A63B 53/04

[52] U.S. Cl. ..... 473/331; 473/350

[58] Field of Search ..... 473/324, 325, 473/326, 327, 328, 329, 330, 331, 332, 345, 346, 347, 349, 350, 342

[56] References Cited

U.S. PATENT DOCUMENTS 1,756,219 4/1930 Spiker ..... 473/251
3,847,399 11/1974 Raymont .
5,090,702 2/1992 Viste .
5,601,501 2/1997 Kobayashi ..... 473/350
5,611,742 3/1997 Kobayashi ..... 473/345

FOREIGN PATENT DOCUMENTS 60-177867 11/1985 Japan .
2-241469 9/1990 Japan .
6-31766 4/1994 Japan .

*Primary Examiner*—Sebastiano Passaniti
*Attorney, Agent, or Firm*—Quarles & Brady

[57] ABSTRACT

A method for manufacturing a golf club head, which enables a face to be formed thinner to realize a more free distribution of weight. A flat surface 1A of a head body 1 is formed with plural cavities 6 to strengthen a face 4. Thus, the face 4 can be made thinner, which enables the distributing of thus obtained surplus weight to other parts of the head body 1. Each cavity 6 is disposed opposite to an area 9A between adjacent score lines 5. Accordingly, sufficient thicknes A of the face 4 can be guaranteed to prevent the degradating of strength caused by forming the thinner face 4.

10 Claims, 6 Drawing Sheets

METHOD FOR MANUFACTURING IRON-TYPE GOLF CLUB HEAD

BACKGROUND OF THE INVENTION (a) Field of the Invention

The present invention relates to a method for manufacturing an iron-type golf club head such as an iron, sand wedge or pitching golf club head.

(b) Description of Prior Art

For this kind of golf club head, there is proposed a golf club head disclosed in Japanese U.M.Appln Laid-Open No. 60-177867, which discloses a golf club head having multiple cavities at its back. The prior golf club head aimed at decreasing air resistance when swinging the same by forming the multiple cavities at the back of the head body which had been conventionally formed smooth. Further, there is also proposed another golf club head disclosed in Japanese Patent Appln Laid-Open No. 2-241469, which discloses in its FIG.1 a wood-type golf club head having small cavities formed along a peripheral portion of the head body by cutting process. According to the latter prior golf club head, the said small cavities could enhance a sense of beauty also. In addition, U.S. Pat. No. 3,847,399 proposed a honeycomb-shaped structure behind the face, while U.S. Pat. No. 5,090,702 proposed a ball-striking face provided with external grooves and an internal face provided with internal grooves.

However, according to the above conventional golf club heads, the formed cavities or grooves would cause a part of the face to become thinner, resulting in degraded strength thereof. To eliminate the problem, there is proposed another golf club head in Japanese Utility Model Appln Laid-Open No. 6-31766, wherein a golf club head is manufactured by casting, having reinforcing ribs behind a face formed with score lines, each reinforcing rib having greater depth and width than each groove of the score lines with the former being aligned to the latter with respect to position and direction, thereby realizing a sufficient strength withstanding an impact when swinging as well as an improved flow of casting when manufacturing the same.

Whereas, it is widely recognized that for enlargement of so-called sweet area, an iron-type golf club head should have an elongated distance between a face and the CG of a head body, and/or, should have the weight distribution dispersed toward the periphery thereof by thickening a peripheral edge of the face. However, according to the prior golf club heads, the faces must be formed to a preset thickness because of requirement for the strength at the time of striking balls, therefore, a predetermined weight would be inevitably required to ensure the thickness of the face. As a result, there has been a problem such that a golf club head can not be formed thinner as you like.

SUMMARY OF THE INVENTION

To eliminate the above-mentioned problems, it is, therefore, a main object of the present invention to provide a method for manufacturing an iron-type golf club head, of which the face can be optionally formed when the face is formed thinner.

According to a major feature of the present invention, there is provided a method)for manufacturing an iron-type golf club head comprising a metallic head body having a shaft attaching portion at one side and a face at its front side, said face being formed with score lines thereon, which comprises the steps of: a rear surface of said face being formed with a plurality of cavities by forging, each cavity being disposed opposite to an area between the aforesaid adjacent score lines.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which:

FIG. 1 is a section showing a first embodiment of the invention, while

FIG. 2 is a rear view showing a first embodiment of the invention, while

FIG. 5 is a section showing a second embodiment of the invention, while

FIG. 6 is a section showing a third embodiment of the invention, while FIG. 6*a* is a partially enlarged section of FIG. 6.

FIG. 7 is a section showing a fourth embodiment of the invention, while FIG. 7*a* is a partially enlarged section of FIG. 7.

FIG. 8 is a section showing a fifth embodiment of the invention, while FIG. 8*a* is a partially enlarged section of FIG. 8.

DETAILED DESCRIPTION OF THE PREFERRED EMBODIMENTS

Figure 1:
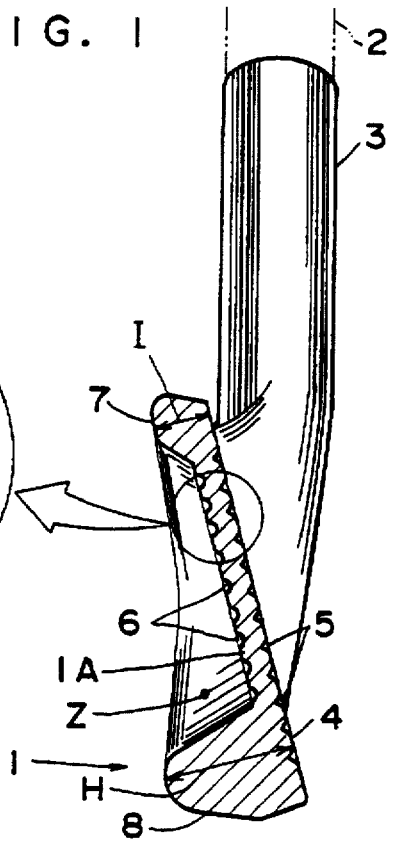

Hereinafter is described a first embodiment of a golf club head of the invention with reference to FIGS. 1 to 4, in which reference numeral 1 designates a metallic head body. The head body 1 has a hosel 3 for mounting a shaft 2 thereto, and a face 4 for striking balls at its front. The face 4 has a thickness A of 1.5 to 3.5 mm, preferably 2.5 mm, having groove-like score lines 5 formed thereon. The score lines 5, each having a width B of 0.7 to 1.0 mm, preferably 0.9 mm, a depth C of 0.3 to 0.6 mm, preferably 0.5 mm and an interval D of 3.0 to 4.0 mm, preferably 3.6 mm, respectively.

A rear surface of the head body 1 is formed with a flatted surface 1A opposite to the face 4, having plural cavities 6 formed rather dense, while a peripheral edge of the rear surface 1A is formed with an annular projection 7, of which the lower part constructs a sole 8.

Figure 1A:
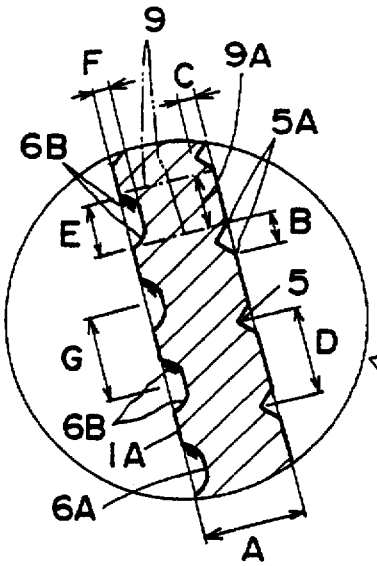
FIG. 1*a* is a partially enlarged section of FIG. 1.
Figure 2A:
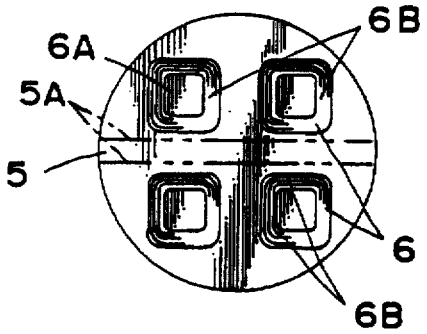
FIG. 2*a* is a partially enlarged section of FIG. 2.
Figure 2:
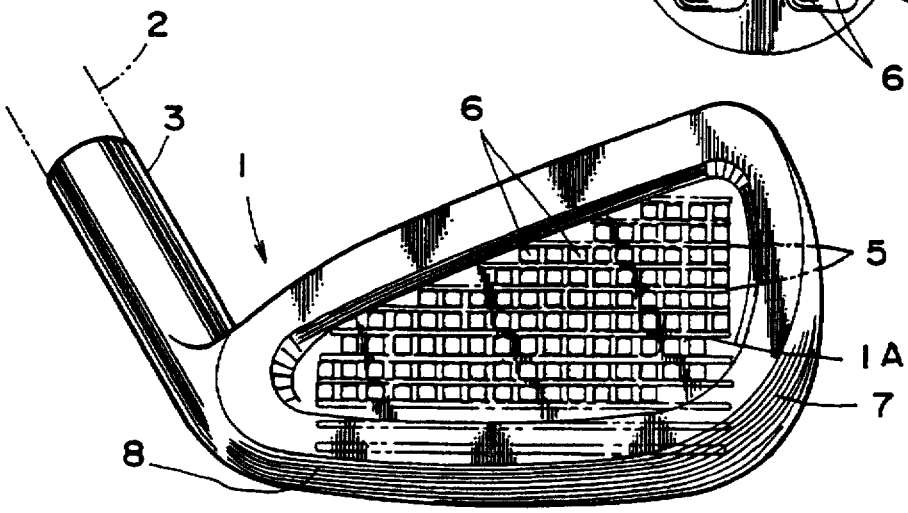
Figure 3:
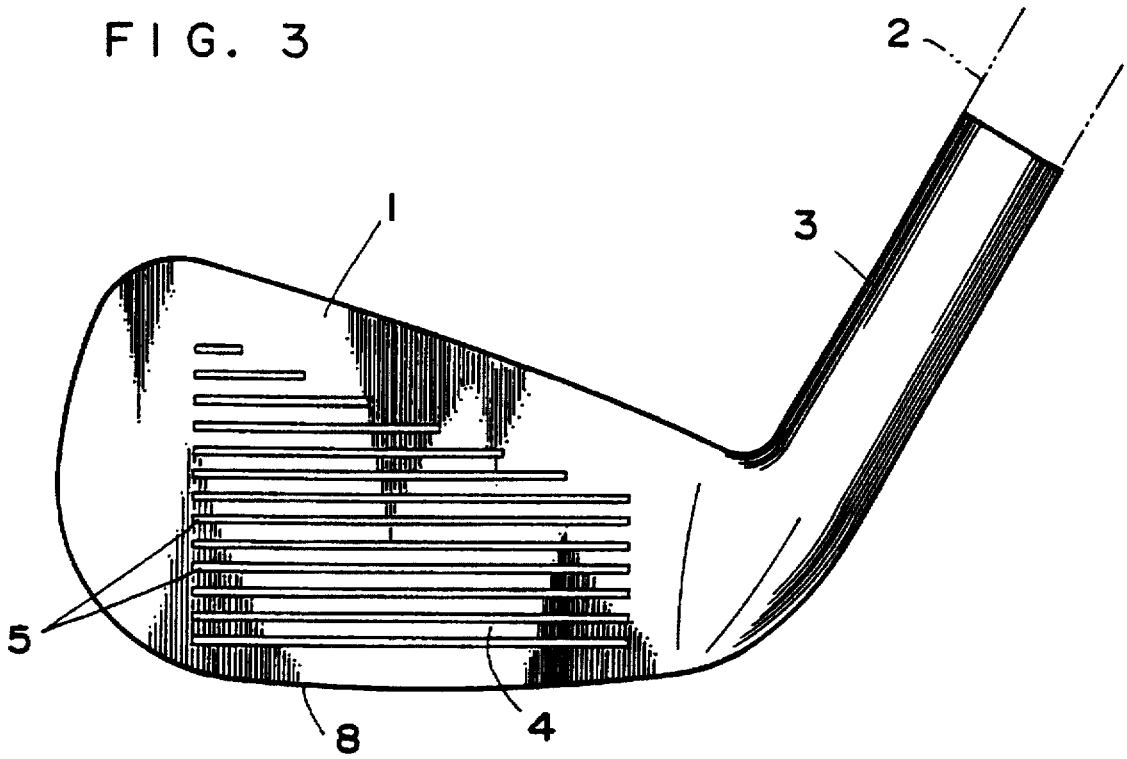
FIG. 3 is a front view showing a first embodiment of the invention.

Each cavity 6 is of a square configuration as seen from its front side, having a curved side surface 6B and a bottom 6A. Additionally, each cavity 6 has a width E ranging from 2.0 to 3.5 mm, preferably 2.9 mm, a depth F from 0.3 to 0.6 mm, preferably 0.5 mm and an interval G of 3.0 to 4.0 mm, preferably 3.6 mm. As illustrated in FIG. 1, the cavities 6 are disposed alternately with the score lines 5 in order that each cavity 6 may be opposed to an interval or a sandwiched area 9A between each score line 5. In other words, the cavities 6 are disposed in parallel to the score lines 5 so that the bottoms 6A thereof are positioned in the areas 9A between each virtual perpendicular extending from the adjacent edges 5A of the score lines 5, as illustrated in FIG. 1*a*. Further, each cavity 6 is disposed longitudinally to form a file thereof in the vertical direction. In a preferred form of the invention, the cavities 6 totaled preferably make up at least 70% of the flatted surface 1A.

6 (sample No. 2) was compared to the plate without the same (sample No. 1).

TABLE 1

Tensile Test

| No. | sample No. | material | test piece: dimension mm | test piece: cross-sectional area mm² | test piece: original gauge length mm | tensile: load N | tensile: tensile strength N/mm² | yield: load N | yield: yield point N/mm² | yield elongation % | reduction of area % |
|---|---|---|---|---|---|---|---|---|---|---|---|
| 1 | 1 | S20C | 5.8 × 24.5 | 142.1 | 49.9 | 75096 | 528.5 | 52920 | 372.4 | 34.1 | — |
| 2 | 2 | " | 6.0 × 24.3 | 145.8 | 49.6 | 73619 | 504.9 | 54517 | 374.0 | 35.5 | — |
| 3 | 3 | " | 5.8 × 24.5 | 142.1 | 50.1 | 90866 | 639.5 | 63337 | 445.7 | 2.0 | — |
| 4 | 4 | " | 5.8 × 24.4 | 141.5 | 50.0 | 91457 | 646.3 | 62475 | 441.5 | 2.6 | — |

Bending Test

| No. | sample No. | material | test piece: cross-sectional dimension mm | test piece: length mm | angle of bend (deg.) | inside radius mm | bearing distance mm | result crack on the outer periphery of the bent piece | remark |
|---|---|---|---|---|---|---|---|---|---|
| 1 | 1 | S20C | 5.9 × 20.0 | 149.8 | 180 | 12 | 36 | none | deformation-starting load note1):4288N |
| 2 | 2 | " | 5.9 × 19.6 | 151.0 | 180 | " | " | fractured | deformation-starting load note1):6370N |

notes
note1) deformation-starting load was assumed to be a proportional limit in a load-elongation diagram.

Next, a method for manufacturing the above-structured golf club head will be described.

Figure 4:
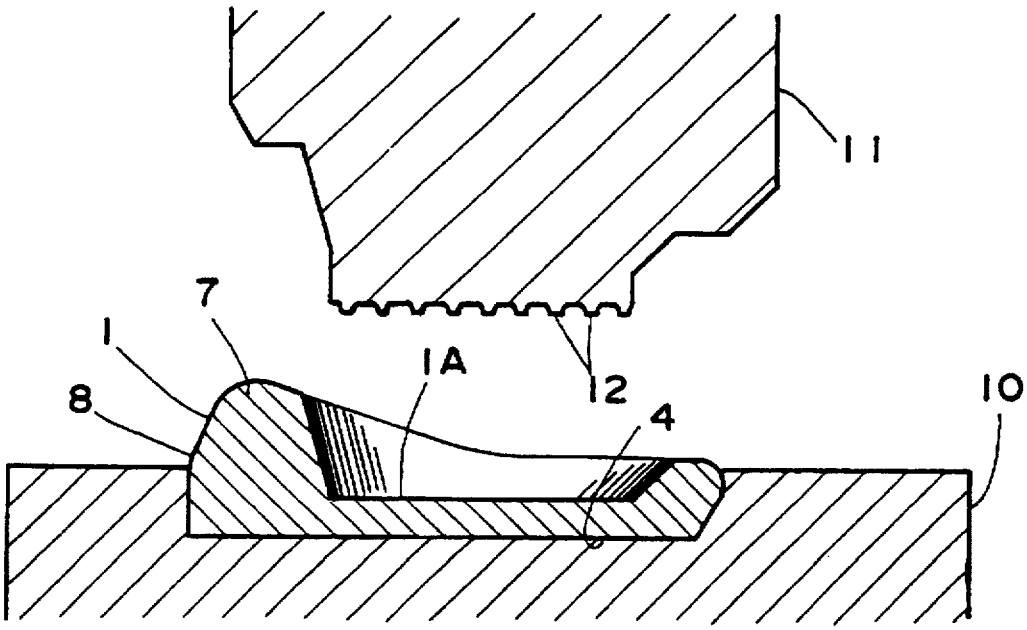
FIG. 4 is an explanatory section illustrating a manufacturing process of a golf club head of a first embodiment of the invention.

For example, as shown in FIG. 4, the face 4 and the flatted surface 1A are each formed in the head 1 in advance by means of hot or cold forging of carbon steels for machine structural use such as JIS standard S20C or S25C or any suitable metal material such as titanium, titanium alloy or beryllium copper alloy. Specifically, the above steel products should undergo annealing process after the hot forging. Next, the head body 1 is placed on a lower die 10 of the forging device, while a lower surface of an upper die 11 is formed with convex portions 12 to form the plural cavities 6. Then, the upper die 11 is pressed onto the flatted portion 1A to simultaneously form the plural cavities 6 by cold forging. For the steel products, such cavities 6 may be formed by hot forging. After thus forming the cavities 6, the score lines 5 are formed, and then, the surface is polished to a final product.

According to a first embodiment of the invention, the flatted surface 1A of the head body 1 is formed with plural cavities 6 by forging, whereby the face is strengthened, thus making the thickness A of the face 4 as thin as about 1.0 to 3.5 mm. As a result, you can distribute a surplus weight thus obtained, for example, to the sole 8 in order to enlarge the thickness H thereof, thereby elongating the distance between the center of gravity Z of the head body 1 and the face 4 to enlarge a sweet area, or you can also enlarge a sweet area by distributing the surplus weight to the annular projection 7 to make the thickness I greater. Table 1 shown below indicates the contrast between the results of the tensile tests wherein the plates formed with the equivalents to the cavities 6 (sample Nos. 3 and 4) were compared to the plates without the same (sample Nos. 1 and 2). Further, the Table 1 also shows the contrast between the results of the bending tests wherein the plate formed with the equivalents to the cavities According to the result of the tensile test in Table 1, the average tensile strength of the plates with the cavities (sample Nos. 3 and 4) was 642.2 N/mm², while that of the plates without the cavities (sample Nos. 1 and 2) 516.7 N/mm², which indicated that the forming of the cavities could increase the tensile strength by 24.4%. Whilst, according to the result of the bending test in Table 1, the deformation-starting load of the plate with the cavities (sample No. 2) was 6,370 N, while that of the plate without the cavities (sample No. 1) 4,288 N, which indicated that the forming of the cavities could increase the bending strength by. 48.5%. Such improvement of the strength presumably results from the enhanced toughness and durability of the material associated with the formation of even and fine tissues and grain flows by forming the Cavities by means of forging. Additionally, as the cavities 6 were disposed opposite to the areas 9A between the adjacent score lines, sufficient thickness could be ensured at the back of the score lines 5, thereby eliminating the fear of degraded strength which might possibly caused by the above formation of the cavities 6. In addition, the cavities 6 have the smooth curved surface 6B and the bottom 6A respectively, whereby any disconnection of the grain flows will be hardly occur, thus realizing increased strength of the golf club head.

Referring to FIGS. 5 to 8 showing second to fifth embodiments of the invention, each of which cavities being square or rectangular-shaped as seen from its front side, the same portions as those described in a first embodiment will be designated as common reference numbers and their repeated detailed descriptions will be omitted.

Figure 5A:
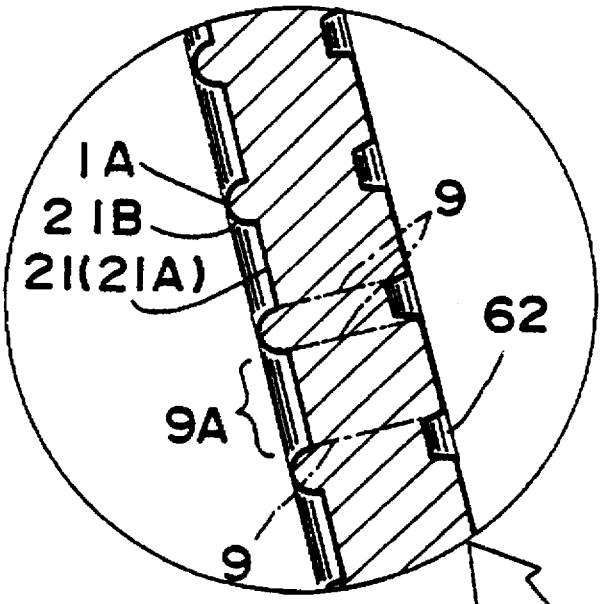
FIG. 5*a* is a partially enlarged section of FIG. 5.
Figure 5:
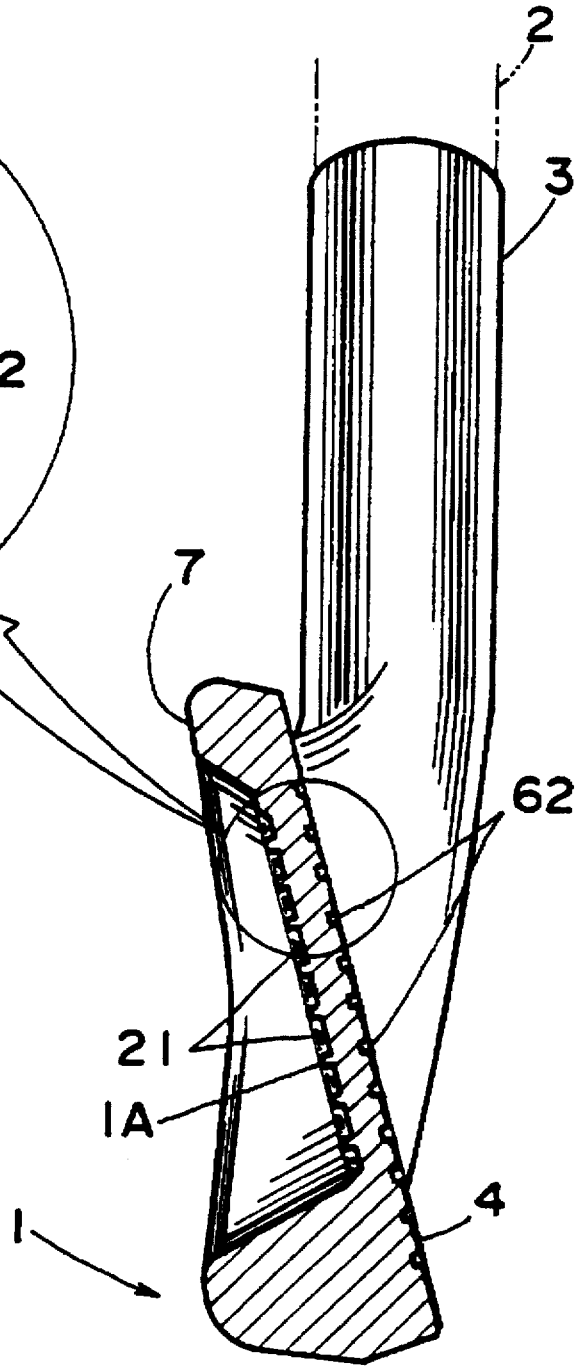
Figures 6, 6A:
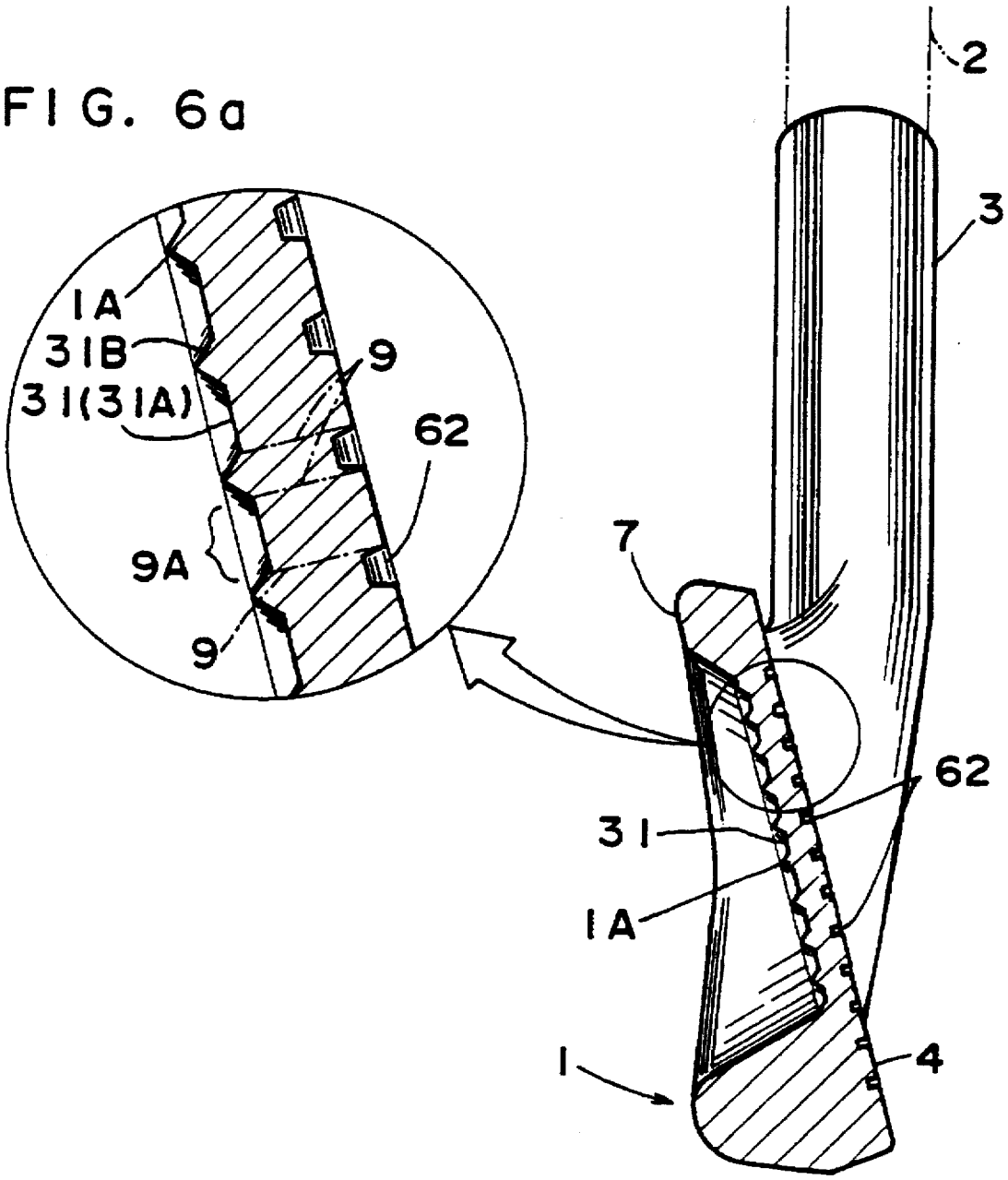
Figures 7, 7A:
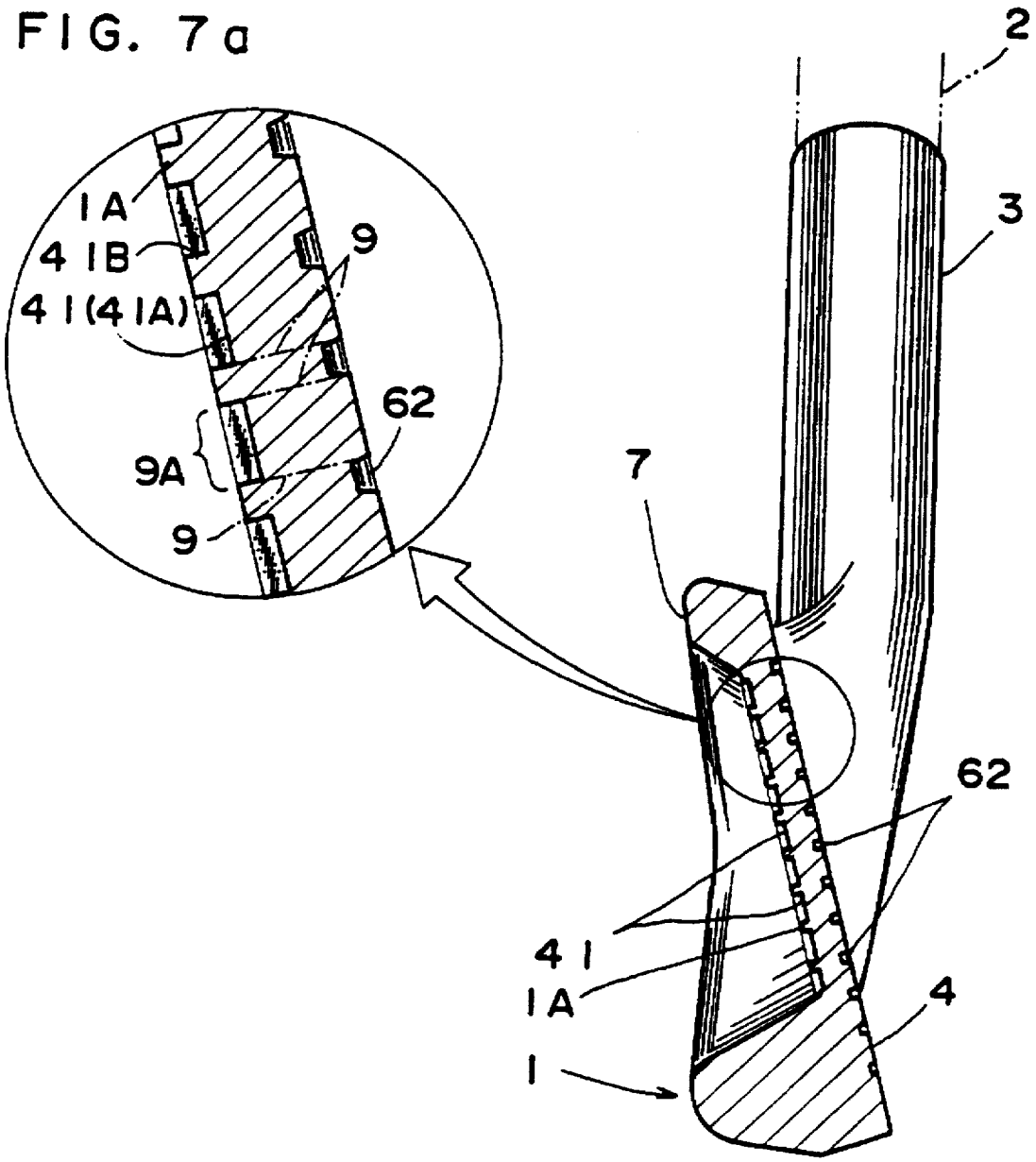

In FIG. 5 showing a second embodiment, each of cavities 21 formed by forging has a flat bottom 21A and an arc-shaped side surface 21B, while the face 4 is formed with score lines 62, each having a trapezoidal or rectangular section. With the structure thus made, a volume sandwiched by the adjacent side surfaces 21B can be diminished, thus distributing a surplus weight to other parts of the head 1 to enlarge a sweet area. Likewise, in FIG. 6 showing a third embodiment, each cavity 31 formed by forging has a flat bottom 31A and a side surface 31B having an inclined plane, which obliquely extends outwardly from the bottom 31A, whereby the adjacent side surfaces 31B define a triangle section. With the structure thus made, a volume sandwiched by the adjacent side surfaces 31B can be decreased, thus distributing a surplus weight to other parts of the golf club head in order to enlarge a sweet area. In FIG. 7 showing a fourth embodiment, each cavity 41 has a flat bottom 41A and a side surface 41B disposed at right angles relative to the rear surface 1A, thereby constructing a rectangular section with the adjacent side surface 41B. Accordingly, a volume between the adjacent side surfaces 41B can be relatively decreased, thus allowing so obtained surplus weight to be distributed to other parts of the head to enlarge a sweet area.

Figures 8, 8A:
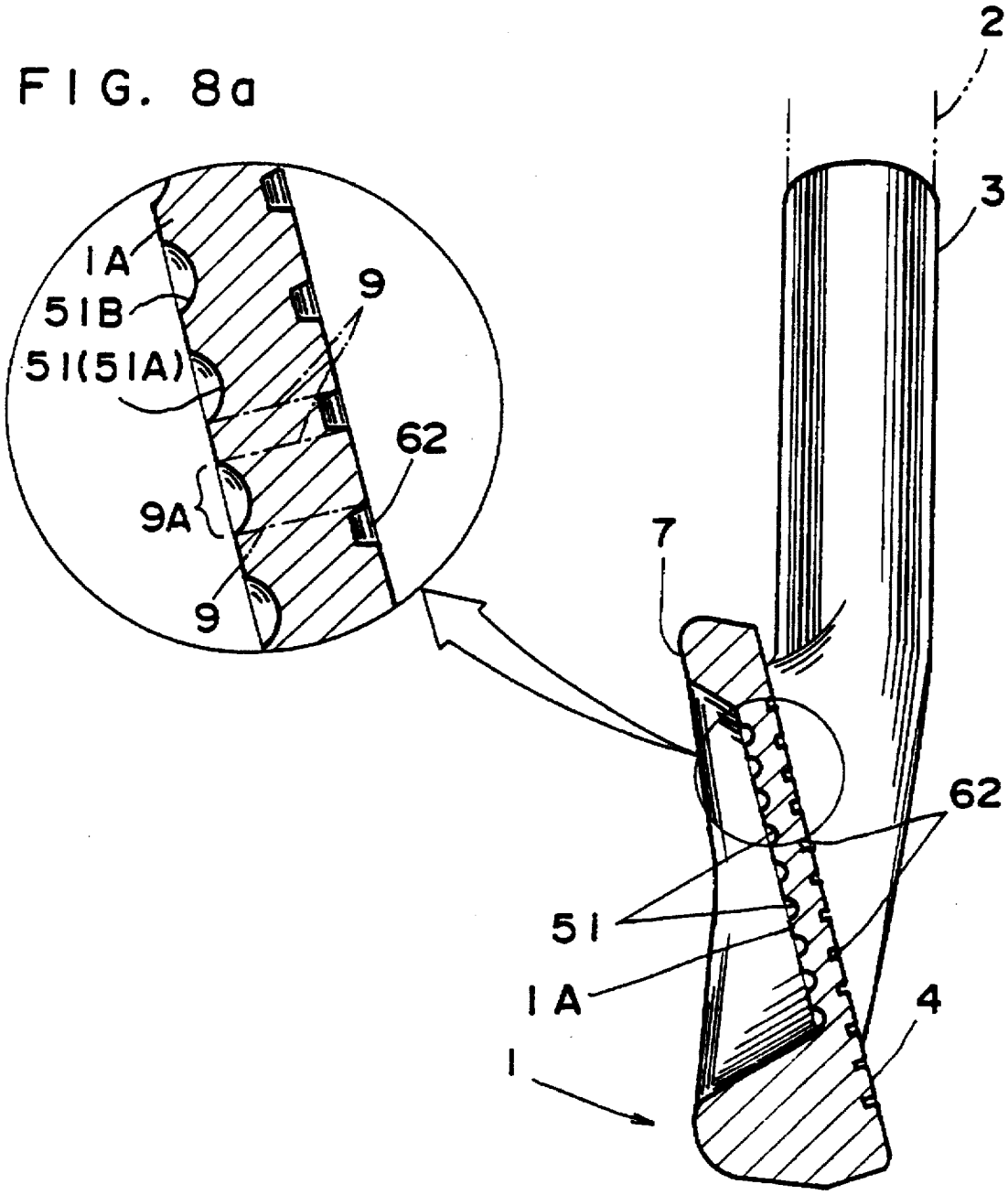

In FIG. 8 showing a fifth embodiment, the flatted surface 1A is formed with cavities 51, each having a gently-curved surface 51B and a bottom 51A, while the face 4 is formed with score lines 62, each having a trapezoidal or rectangular section.

In all of the second to fifth embodiments, the same action and effect can be attained as a first embodiment.

Incidentally, the present invention should not be limited to the foregoing embodiments, but may modified within a technical scope of the invention. For example, the configurations of the cavities formed on the flatted surface of the head may be suitably changed.

What is claimed:

1. An iron-type golf club head having a metallic head body with a shaft attaching portion at one side thereof and a face at a front side thereof, said face being formed with adjacent score lines thereon, which comprises:

a rear surface opposite to said face, said rear surface being formed with a plurality of cavities by forging, wherein forging of said cavities provides grain flows adjacent said cavities, each cavity having a substantially flat bottom area and having at least one inclined side surface extending from said bottom area, wherein the bottom area only is completely disposed within an area opposite to an area between the aforesaid adjacent score lines.

2. The iron-type golf club head according to claim 1, wherein said face is formed to a thickness ranging from 1.5 to 3.5 mm.

3. The iron-type golf club head according to claim 1, wherein said inclined side surface is gently curved relative to the rear surface of said face.

4. The iron-type golf club head according to claim 1, wherein each cavity forms a plurality of arc-shaped side surfaces relative to the rear surface of said face.

5. The iron-type golf club head according to claim 1, wherein said inclined side surface is formed as an inclined plane relative to said bottom area.

6. The iron-type golf club head according to claim 1, wherein each cavity is formed substantially square or rectangular as viewed from said rear surface.

7. The iron-type golf club head according to claim 1, wherein the plurality cavities are formed to line up in at least one file.

8. The iron-type golf club head according to claim 1, wherein said side surface has at least a portion that extends outside said area opposite the area between the aforesaid adjacent score lines.

9. The iron-type golf club head according to claim 1, wherein each of said score lines has a width ranging from 0.7 to 1.0 mm and a depth ranging from 0.3 to 0.6 mm, while each of said cavities has a width ranging from 2.0 to 3.5 mm, and a depth ranging from 0.3 to 0.6 mm.

10. The iron-type golf club head according to claim 8, wherein said head body is made of steel, pure titanium, titanium alloy, beryllium or copper alloy.

* * * * *

UNITED STATES PATENT AND TRADEMARK OFFICE

CERTIFICATE OF CORRECTION

Patent No. : 5,676,605

Dated : October 14, 1997

Inventor : Kenji Kobayashi

It is certified that error appears in the above-identified patent and that said Letters Patent is hereby corrected as shown below:

Col. 1, line 62, after "method" please delete ")".

Col. 3, line 61, "Table 1" should be the start of a new paragraph.

Col. 4, line 47, delete "Cavities" and substitute "cavities".

Col. 5, line 15, delete "surface" and substitute "surfaces".

Signed and Sealed this

Ninth Day of March, 1999

*Attest:*

*Attesting Officer*

Q. TODD DICKINSON

*Acting Commissioner of Patents and Trademarks*